US010384119B2

(12) United States Patent
Toumanios

(10) Patent No.: US 10,384,119 B2
(45) Date of Patent: Aug. 20, 2019

(54) THREE SIDED DIE

(71) Applicant: Joseph Aaron Toumanios, Farifield, NJ (US)

(72) Inventor: Joseph Aaron Toumanios, Farifield, NJ (US)

( * ) Notice: Subject to any disclaimer, the term of this patent is extended or adjusted under 35 U.S.C. 154(b) by 449 days.

(21) Appl. No.: 14/121,305

(22) Filed: Aug. 18, 2014

(65) Prior Publication Data

US 2018/0207517 A1 Jul. 26, 2018

(51) Int. Cl.
*A63F 9/04* (2006.01)

(52) U.S. Cl.
CPC ..... *A63F 9/0415* (2013.01); *A63F 9/0413* (2013.01); *A63F 2009/042* (2013.01)

(58) Field of Classification Search
CPC . A63F 9/0415; A63F 9/0413; A63F 2009/042
USPC ..... 273/146, 288; D21/372, 373
See application file for complete search history.

(56) References Cited

U.S. PATENT DOCUMENTS 3,811,677 A * 5/1974 Saladrigas ..... A63B 25/00 273/118 R
D235,073 S * 5/1975 Warren ..... D21/373
5,156,406 A * 10/1992 Johnson ..... A63F 3/00 273/248
5,203,562 A * 4/1993 Smith ..... A63F 9/0415 273/146
5,791,651 A * 8/1998 Bryant ..... A63F 3/00157 273/146
6,042,116 A * 3/2000 Underwood ..... A63F 9/0415 273/146
D445,140 S * 7/2001 Odenwalt ..... D21/373
D687,606 S * 8/2013 Burger ..... D30/160
D801,438 S * 10/2017 Fjelstad ..... D21/373
2008/0265505 A1* 10/2008 DeRuyter ..... A63F 9/0413 273/146

FOREIGN PATENT DOCUMENTS

GB 2131304 A * 6/1984 ..... A63F 9/0415

* cited by examiner

*Primary Examiner* — Vishu K Mendiratta
(74) *Attorney, Agent, or Firm* — Philip M. Weiss; Weiss & Weiss

(57) ABSTRACT

A die having three sides in the form of a cube wherein the cube is altered to portray only three face values that appear to a user.

6 Claims, 8 Drawing Sheets

THREE SIDED DIE

FIELD OF THE INVENTION

The present invention relates to a die having three sides.

BACKGROUND OF THE INVENTION

U.S. Pat. No. 7,201,374 relates to a game toy or article of manufacture that includes a set of rules and at least one model. Methods of game play are taught. FIG. 5G shows a type of three sided die.

U.S. Des Pat. No. 412,537 relates to a design of a three sided die.

U.S. Pat. No. 6,042,116 relates to a three sided die having three edges and three sides. A first edge has an identical symbol on either side of the first edge representing the number one. A second edge has another identical symbol on either side of the second edge representing the number two. A third edge has another identical symbol on either side of the third edge representing the number three.

Dice have commonly existed with 12, 8, 6 or 4 sides. There are also variations of a three sided die.

When one refers to a three faced die, the most common shape thought of is a triangular prism. This shape does not allow the die to roll, nor does it have a ⅓ chance of landing on each side. In this shape, two numbers would be seen as the die lands; therefore, one would have to accept the number on the bottom face as the outcome.

One could consider inscribing 1, 2, and 3 twice each on the sides of a cube. This creates a loaded die and corrupts the probability of random occurrence.

SUMMARY OF THE INVENTION

The present invention is a three sided die. The three sided die is in the form of a cube. It is an object of the present invention for the cube to be altered so it portrays only three face values that appear on the top of the die. The die rolls and bounces as a conventional 6-faced die would. The die presents a number unambiguously with precisely ⅓ chance of occurrence. This is accomplished by the unique angled surface facing up regardless of the type of surface where the die is rolled.

It is an object of the present invention for the die to produce unique statistical results. The design of the die of the present invention allows the die to roll as a normal six-sided die would in a random manner, without landing on an unnumbered side. It invariably displays a unique number randomly face up.

It is an object of the present invention for the die to be balanced equally on all sides. It is an object of the present invention for the die to have uniform density throughout. It is an object of the present invention for the die to be formed of a single material. It is an object of the present invention for each side of the die to have a number on it. It is an object of the present invention for the die to have the numbers 1, 2, and 3 respectively, on each side of the die.

It is an object of the present invention for the die to be a cube with three faces diagonally placed joining two sides, each face leaving two protruding corners.

It is an object of the present invention for the die to be a wire-frame cube that has three faces diagonally placed joining two diametrically opposite corners. The surfaces that present the numbers connect diametrically opposite corners in the void left inside the wire-frame.

DETAILED DESCRIPTION OF THE INVENTION

Figure 1:
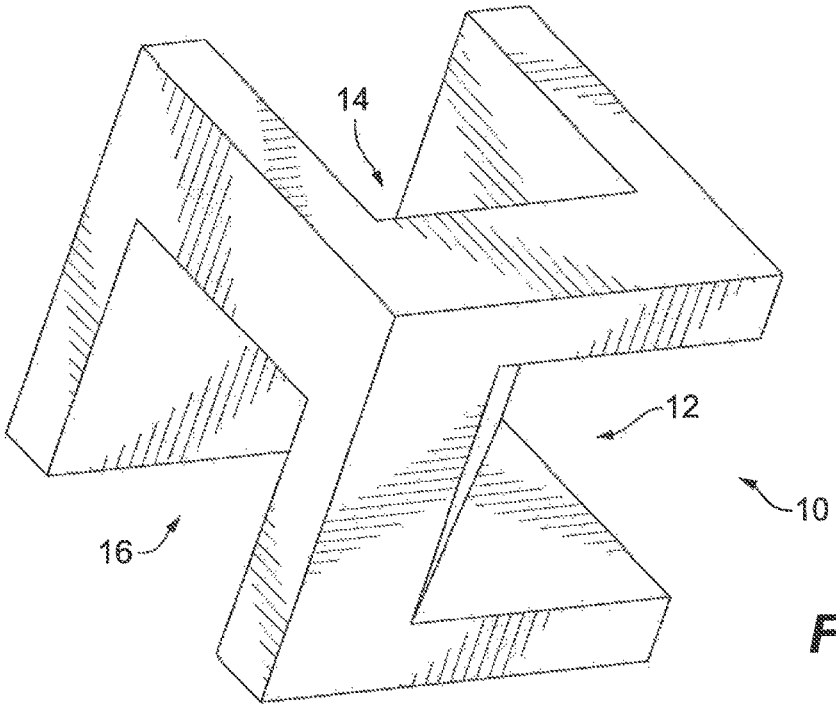
FIG. 1 is a top view of an embodiment of the device of the present invention.

FIG. 1 shows a device 10 comprising a die in the form of a cube with three faces 12, 14 and 16.

Figure 2:
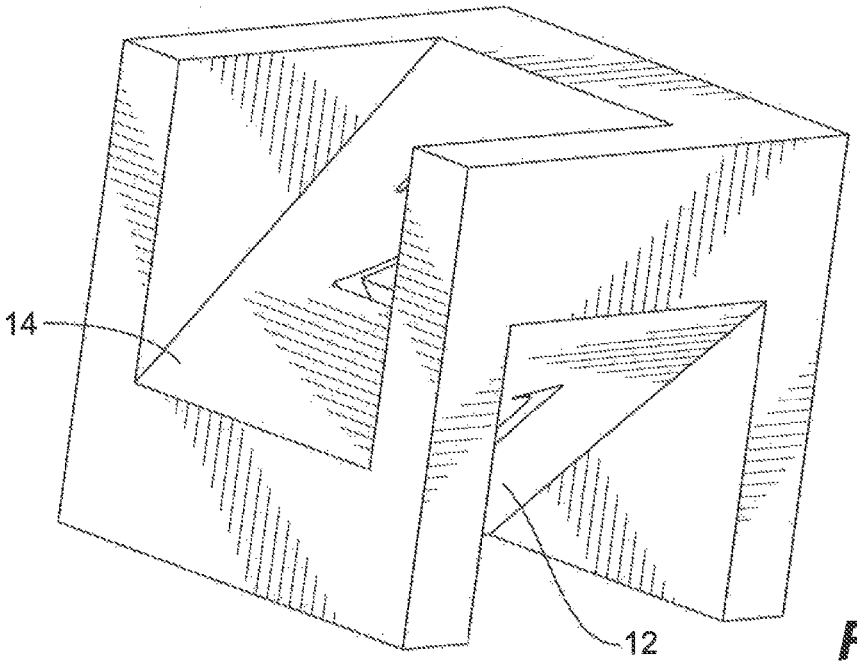
FIG. 2 is a side view of an embodiment of the device of the present invention.

FIG. 2 shows the side view of the device 10 showing face 12 having the number 1 on it and face 14 having the number 2 on it.

Figure 3:
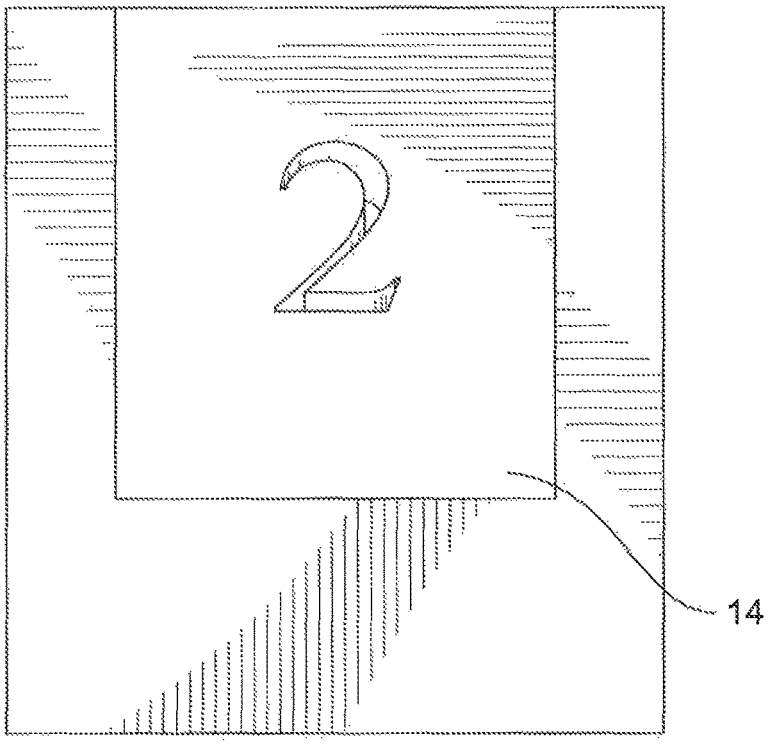
FIG. 3 is a side view of an embodiment of the device of the present invention.

FIG. 3 shows a side view of the device 10 showing the face 14 having the number 2 on it.

Figure 4:
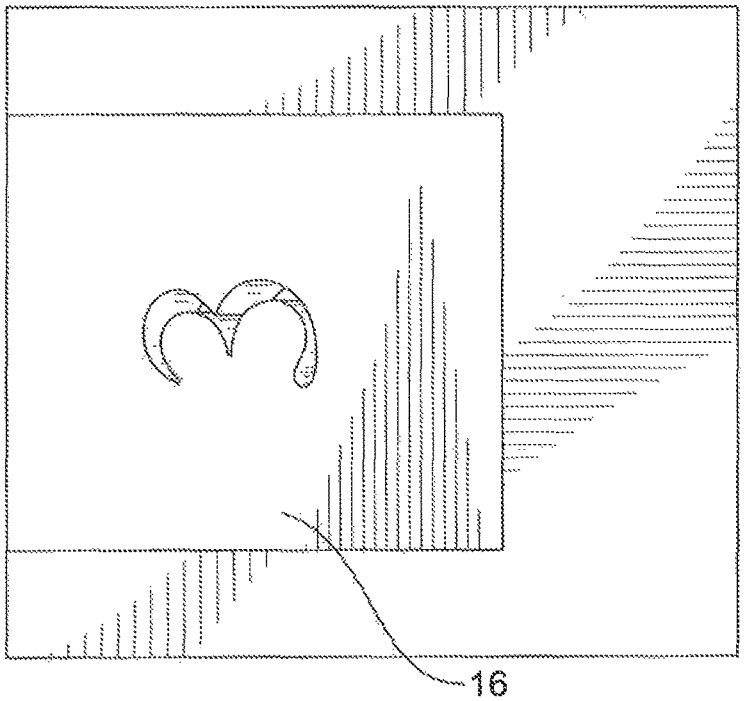
FIG. 4 is a side view of an embodiment of the device of the present invention.

FIG. 4 shows the device 10 showing the face 16 having the number 3 on it.

Figure 5:
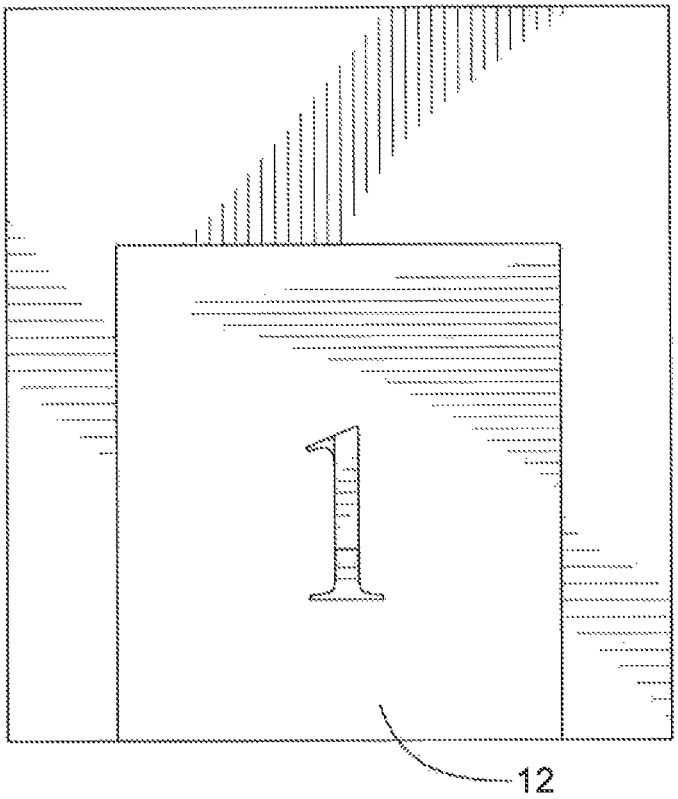
FIG. 5 is a side view of an embodiment of the device of the present invention.

FIG. 5 shows the device 10 showing the face 12 having the number 1 on it.

Figure 6:
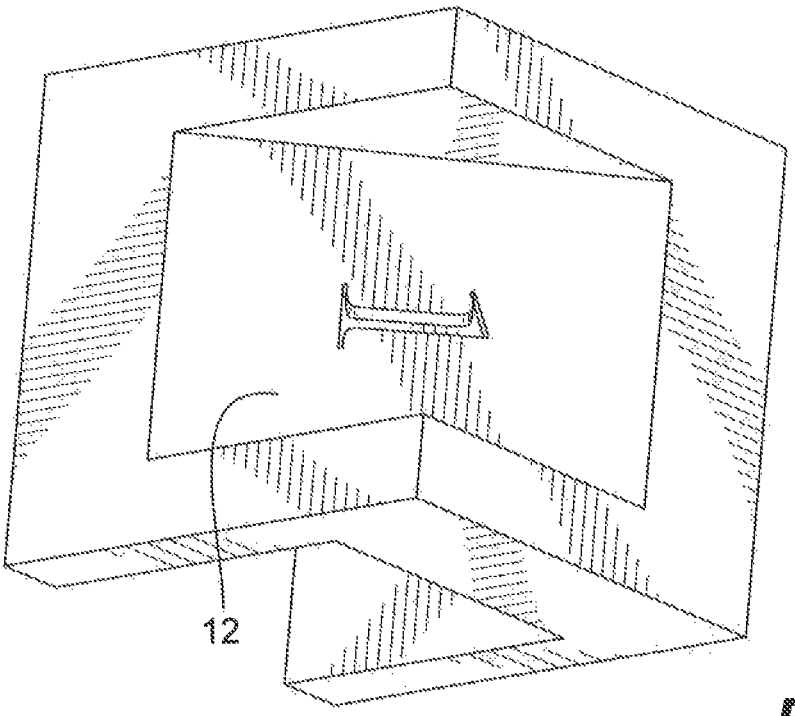
FIG. 6 is a top view of an embodiment of the device of the present invention.

FIG. 6 shows a top view of the device 10 showing the face 12 having the number 1 on it.

Figure 7:
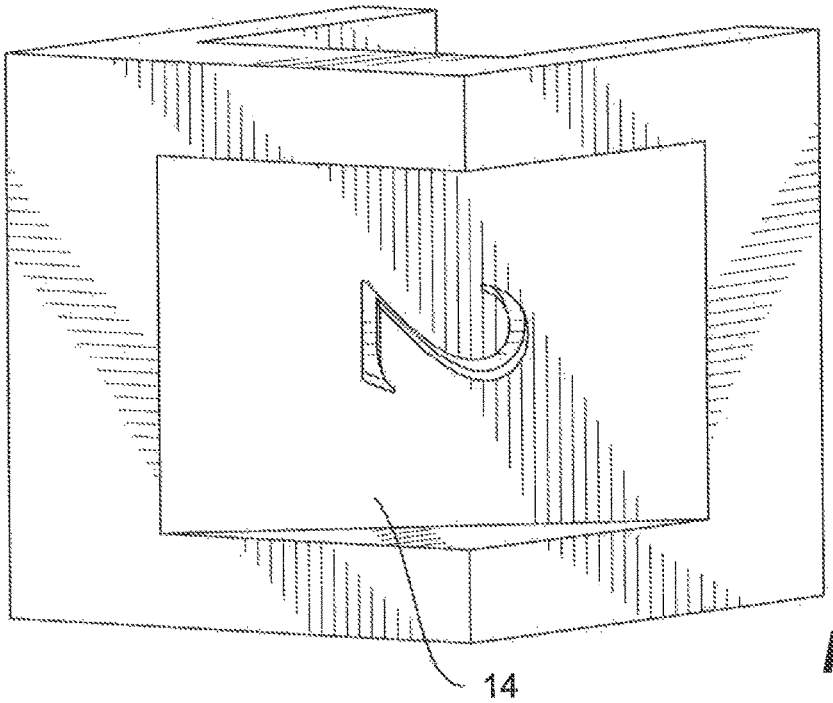
FIG. 7 is a top view of an embodiment of the device of the present invention.

FIG. 7 shows the device 10 showing the face 14 having the number 2 on it.

Figure 8:
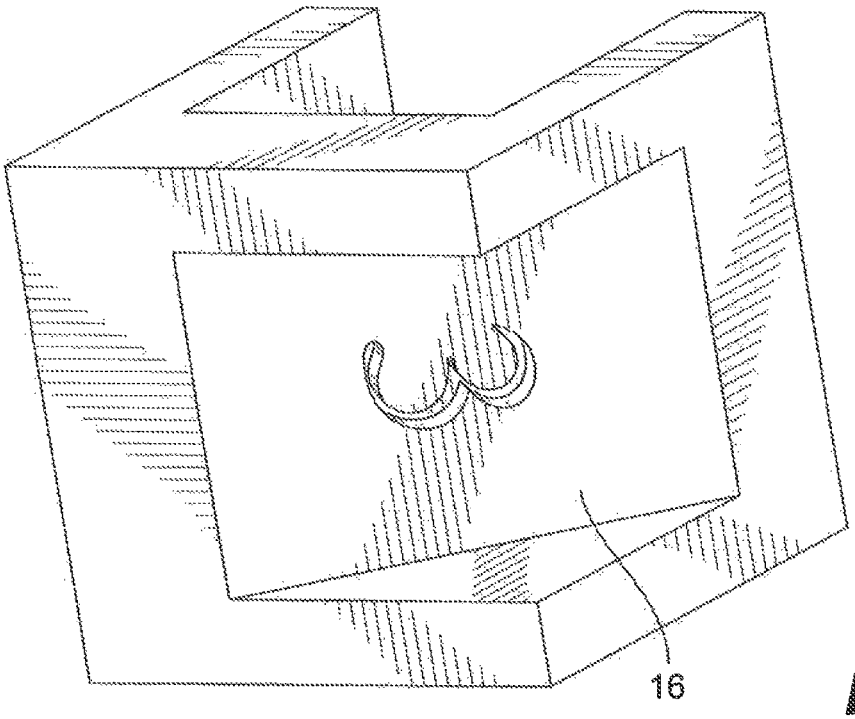
FIG. 8 is a top view of an embodiment of the device of the present invention.

FIG. 8 shows the device 10 showing the face 16 having the number 3 on it.

Figure 9:
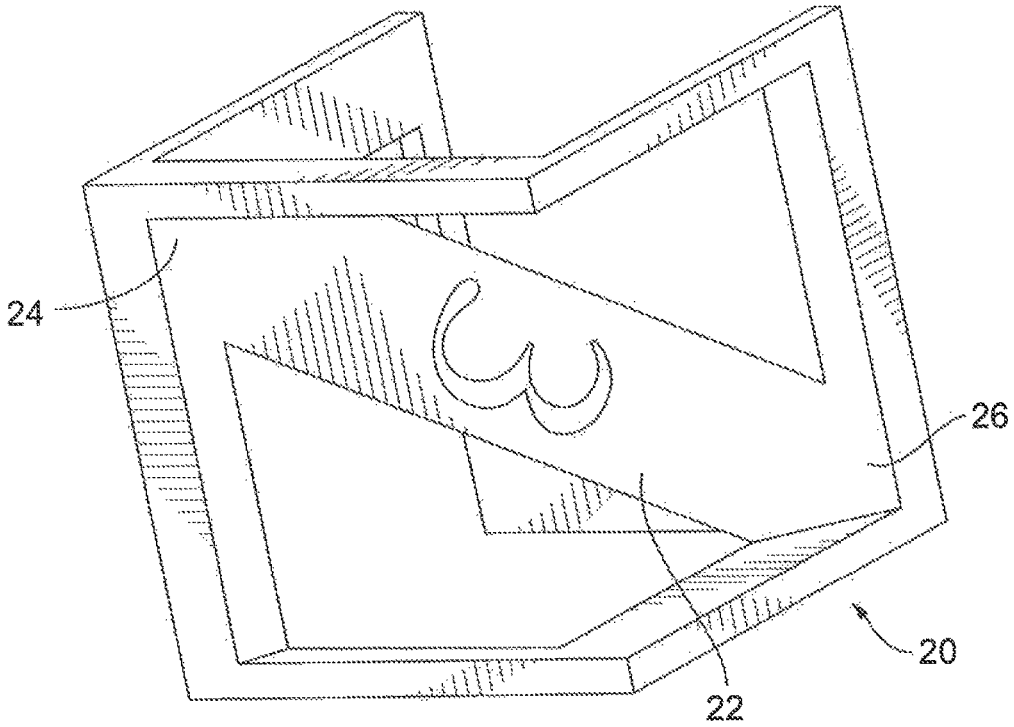
FIG. 9 is a side view of an embodiment of the device of the present invention.

FIG. 9 is shows a side view of device 20 comprising a wire frame cube that shows a diagonal piece 22 joining two diametrically opposite corners 24 and 26 wherein the diagonal piece 22 is labelled with the number 3.

Figure 10:
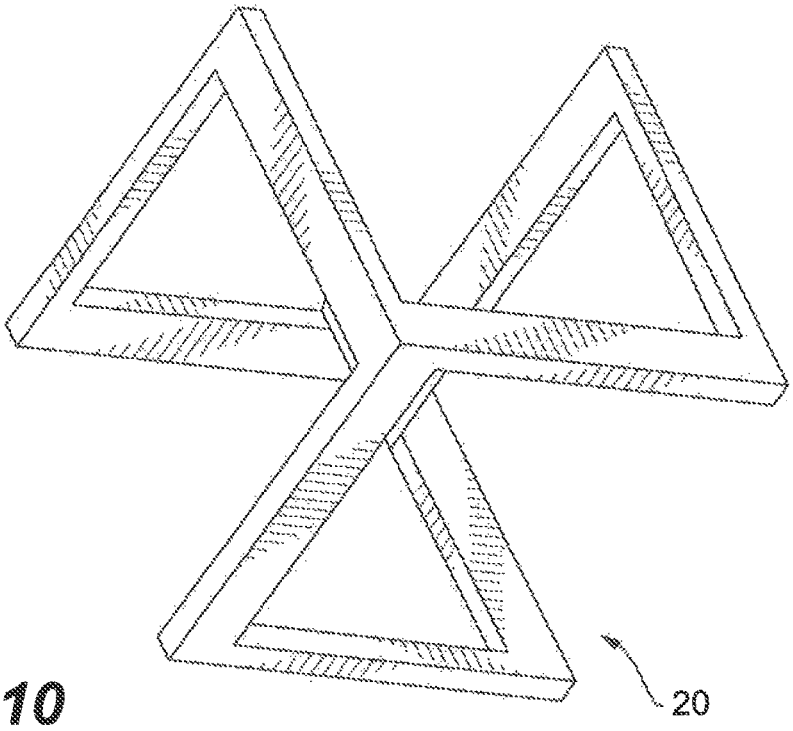
FIG. 10 is a top view of an embodiment of the device of the present invention.

FIG. 10 shows a top view of the device 20 showing the wire frame cube that has three faces diagonally placed joining two diametrically opposite corners.

Figure 11:
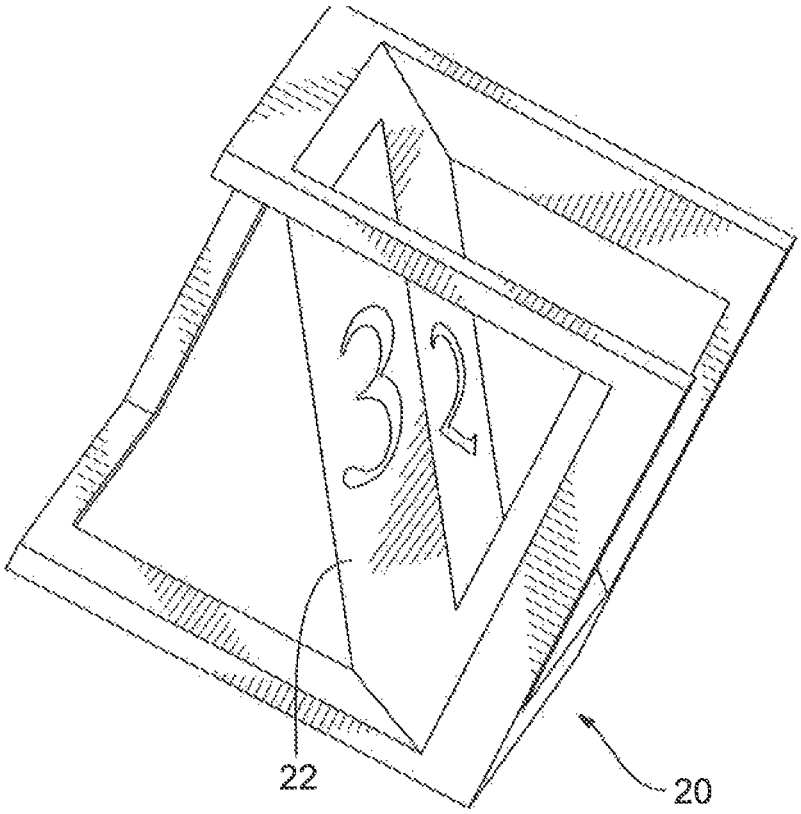
FIG. 11 is a side view of an embodiment of the device of the present invention.

FIG. 11 shows a side view of the device 20 showing the diagonal piece 22 showing the number 3.

Figure 12:
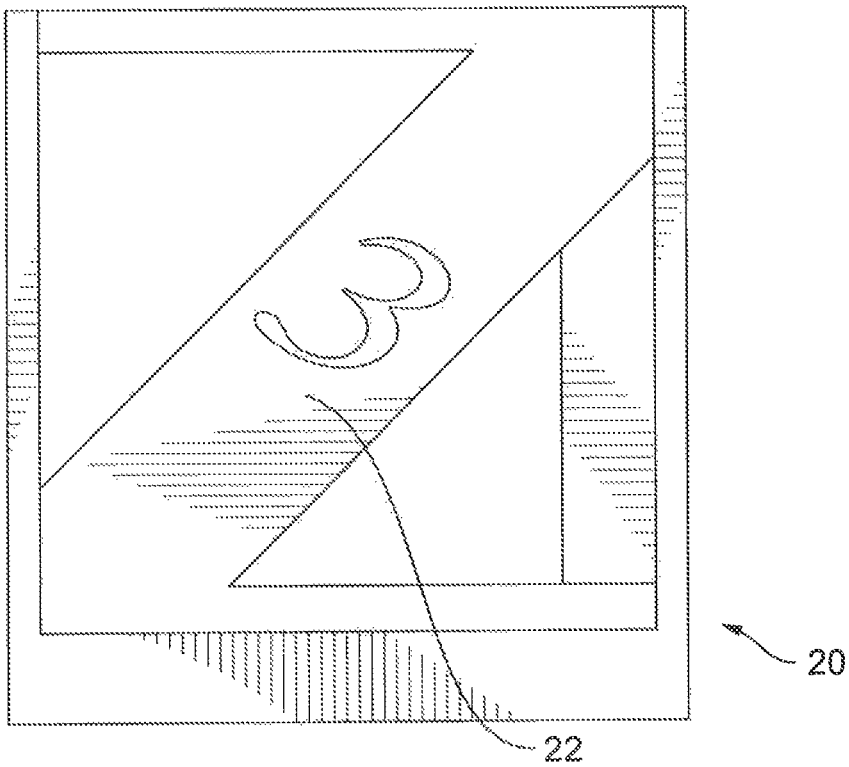
FIG. 12 is a side view of an embodiment of the device of the present invention.

FIG. 12 shows a side view of the device 20 showing the diagonal piece 22 showing the number 3.

Figure 13:
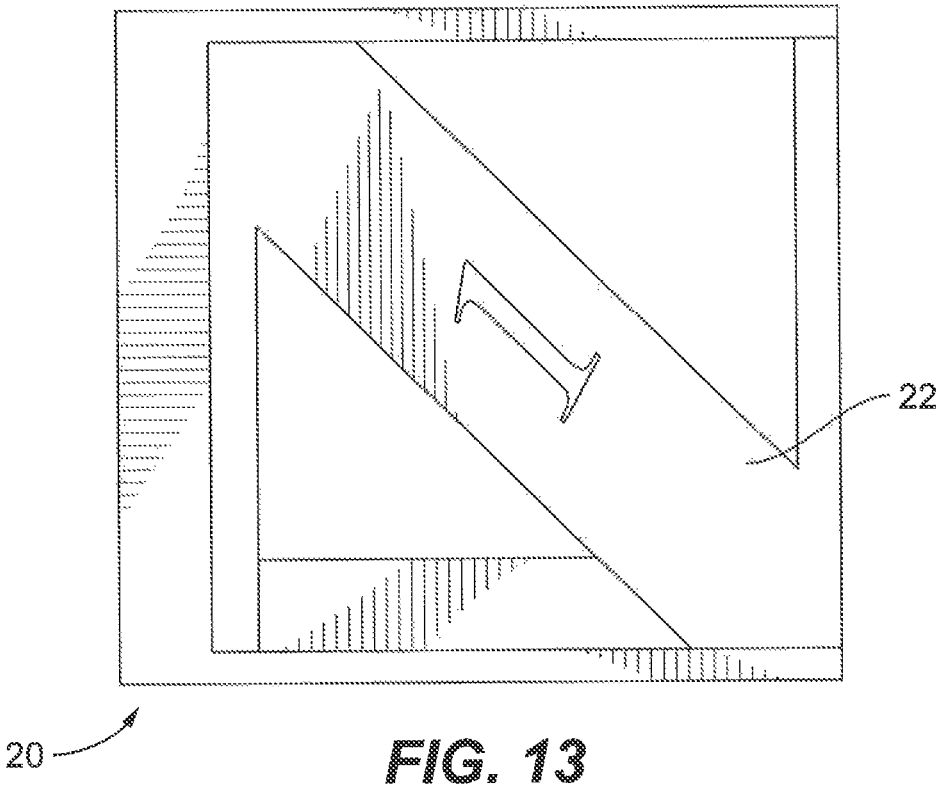
FIG. 13 is a side view of an embodiment of the device of the present invention.

FIG. 13 shows a side view of the device 20 showing the diagonal piece 22 showing the number 1.

Figure 14:
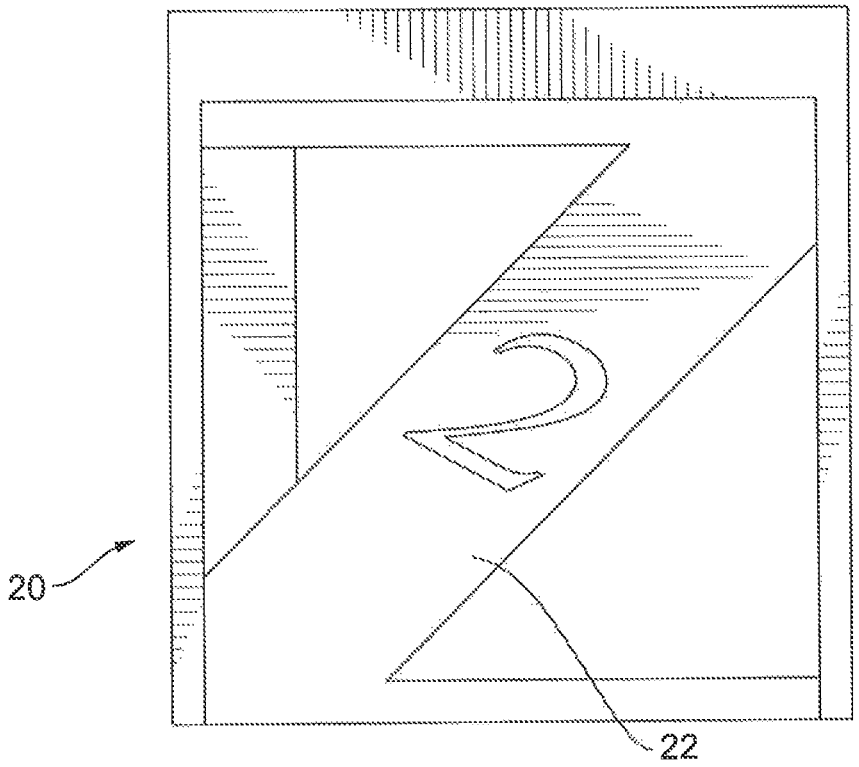
FIG. 14 is a side view of an embodiment of the device of the present invention.

FIG. 14 shows a side view of the device 20 showing the diagonal piece 22 showing the number 2.

Figure 15:
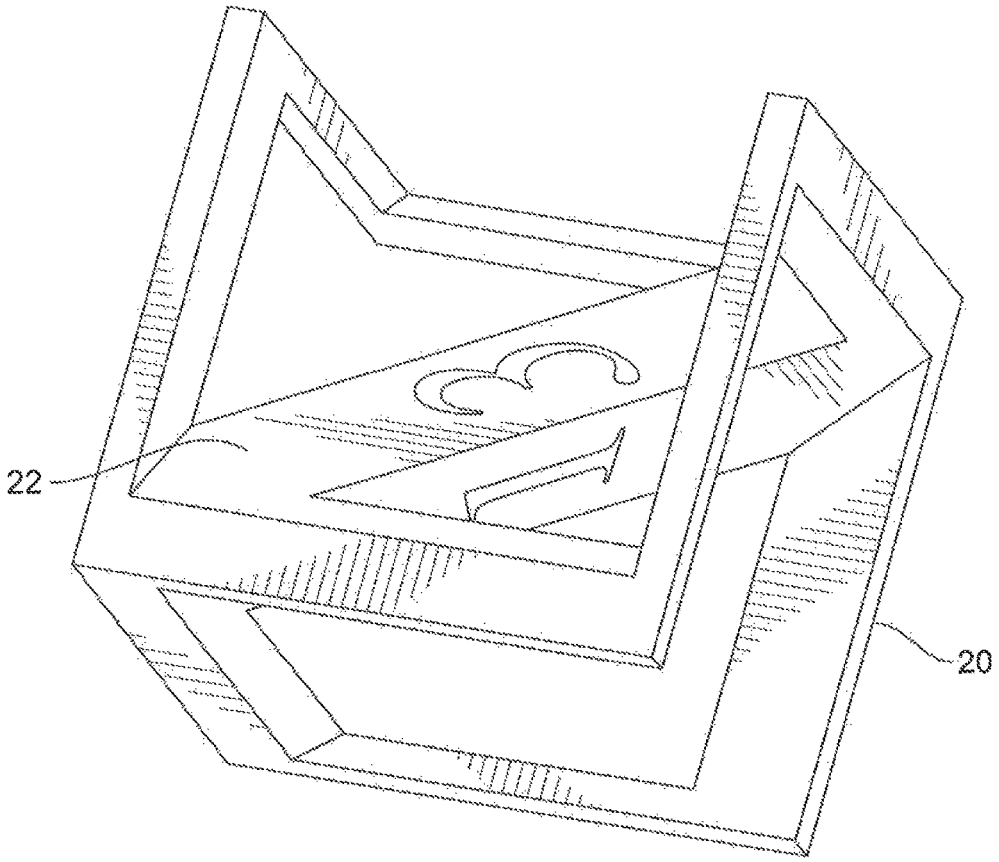
FIG. 15 is a top view of an embodiment of the device of the present invention.

FIG. 15 shows a top view of the device 20 showing the diagonal piece 22 showing the numbers 3 and 1.

The invention claimed is:

1. A die comprising:

three angled and recessed faces; each of the angled and recessed faces being rectangular shaped and distinguished by a number marked on; wherein, each of the angled and recessed faces of said die is created by triangularly shaped voided sections in a cube wherein each of the triangularly shaped voided section is defined by a central portion of a common edge of the cube and equal portions of the two adjoining sides of the cube, resulting in each angled flat and recessed face of the die; said die portraying only one of the three angled faces upward at a time as a result of rolling.

2. The device of claim 1 wherein said die rolls and bounces similar to a cube, with its own interactions, unique to its geometry.

3. The device of claim 1 wherein said die presents a single face unambiguously upward with precisely a ⅓ chance of occurrence.

4. The device of claim 1 wherein said die rolls and tubes similar to a cube, allowing equal possibility of any one of the three designated faces to be displayed upwards.

5. The device of claim 1 wherein said die is made from a single material of uniform density, relying exclusively on its geometry and voided space to present one of three faces upwards.

6. The device of claim 1 wherein said die has no more than three, identical faces, distinguishable by a given number 1, 2, or 3.

* * * * *